US007555989B2

(12) United States Patent
Sherman

(10) Patent No.: US 7,555,989 B2
(45) **Date of Patent: *Jul. 7, 2009**

(54) MODULAR TABLE SYSTEM

(76) Inventor: Brad J. Sherman, 201 NW. 39th St., #308, Seattle, WA (US) 98107

( * ) Notice: Subject to any disclaimer, the term of this patent is extended or adjusted under 35 U.S.C. 154(b) by 24 days.

This patent is subject to a terminal disclaimer.

(21) Appl. No.: 11/522,114

(22) Filed: Sep. 15, 2006

(65) Prior Publication Data

US 2007/0062421 A1 Mar. 22, 2007

Related U.S. Application Data

(63) Continuation-in-part of application No. 10/838,284, filed on May 4, 2004, now Pat. No. 7,107,914.

(51) Int. Cl.
*A47B 57/00* (2006.01)

(52) U.S. Cl. ..... 108/64; 108/65

(58) Field of Classification Search ..... 108/64, 108/65, 66, 67, 69, 59, 77, 70
See application file for complete search history.

(56) References Cited

U.S. PATENT DOCUMENTS

| | | | |
|---|---|---|---|
| 2,484,283 | A | 10/1949 | Gilbert et al. |
| 2,836,475 | A | 5/1958 | Sapp |
| 3,053,598 | A | 9/1962 | Cheslow |
| 3,714,906 | A | 2/1973 | Finestone |
| 3,741,852 | A | 6/1973 | Keener |
| 3,742,869 | A | 7/1973 | Polsky et al. |
| 3,955,850 | A | 5/1976 | Toso |
| D268,715 | S | 4/1983 | Curry |
| D288,756 | S | 3/1987 | McCarty |
| 4,815,392 | A | 3/1989 | Soot |
| 4,878,439 | A | 11/1989 | Samson |
| 5,341,750 | A | 8/1994 | Fuchs |
| 5,438,937 | A | 8/1995 | Ball et al. |
| 5,485,795 | A | 1/1996 | Williams |
| 5,595,427 | A | 1/1997 | Peters et al. |
| 5,622,118 | A | 4/1997 | Rowan |
| 5,673,631 | A | 10/1997 | Guns et al. |
| 5,918,932 | A | 7/1999 | Morrison et al. |
| 5,943,966 | A | 8/1999 | Machado et al. |
| 5,967,058 | A | 10/1999 | Ambrose et al. |
| 6,032,588 | A | 3/2000 | Williamson et al. |
| 6,182,580 | B1 | 2/2001 | Barrett et al. |
| 6,363,866 | B1 | 4/2002 | Schwartz |
| 7,107,914 | B2 * | 9/2006 | Sherman ..... 108/64 |

* cited by examiner

*Primary Examiner*—José V Chen
(74) *Attorney, Agent, or Firm*—Seed IP Law Group PLLC

(57) ABSTRACT

A modular table system formed of modular tables of identical design that can be interleaved to form a larger table. Each individual table utilizes a multi-level tabletop having a top with at least one cutout mounted to a base with at least one cutout, the top and base having nearly identical construction with open areas formed in each that align with corresponding shapes in adjacent tables to permit overlapping and interlacing of the tables to create a sturdy, larger table. The modular tables can be interlaced to form a modular table system with a variety of shapes and patterns.

22 Claims, 21 Drawing Sheets

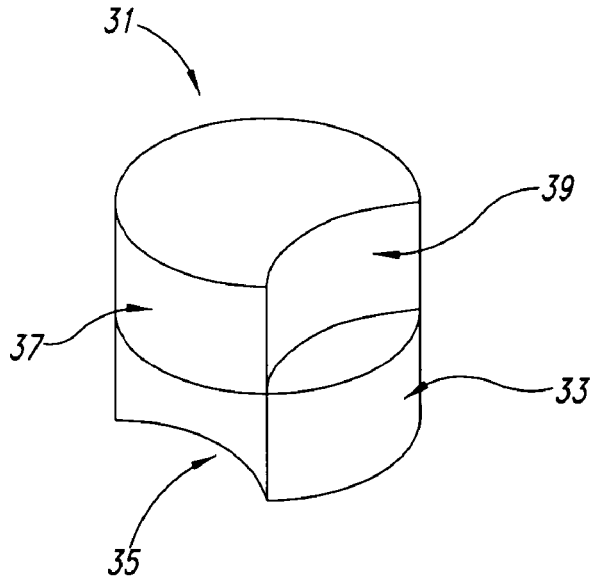
FIG. 9
FIG. 10A
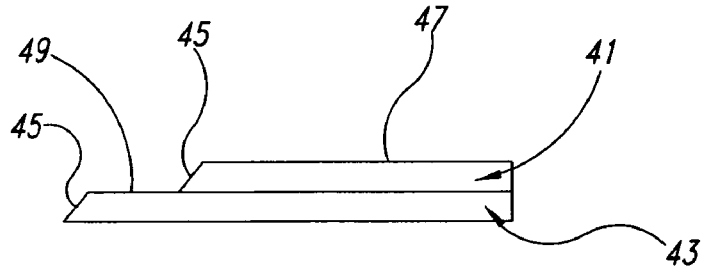
FIG. 10B
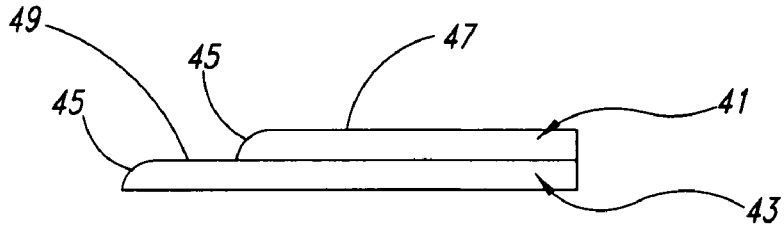
FIG. 10C
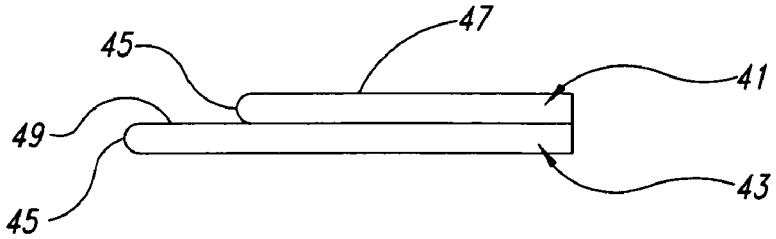

MODULAR TABLE SYSTEM

BACKGROUND OF THE INVENTION

1. Field of the Invention

The present invention pertains to modular furniture and, more particularly, to a tabletop design that interlaces with similar tabletop designs to form a larger tabletop.

2. Description of the Related Art

Conventional tables typically utilize one or more removable leaves or inserts to extend or reduce the usable surface area of the table. Typically, the table is split and extended to form an open space utilizing underside mounted tracks, allowing for one or more table leaves to be inserted into the space. This configuration reduces the overall structural integrity of the table with each added leaf. In addition, the use of extra leaves generally limits the extended length because of the inherent structural weakness. In addition, this approach provides no opportunity to change the width of the table. Moreover, the system of extending tables with leaves also mandates separate storage of the leaf or leaves between uses.

BRIEF SUMMARY OF THE INVENTION

The disclosed embodiments of the invention are directed to a modular tabletop in one embodiment, a modular table in another embodiment, and a modular table system in yet a further embodiment. In accordance with the first embodiment of the invention, a modular tabletop is provided that includes a top having at least one opening configured to receive a similarly-shaped mating portion of another tabletop to form a larger tabletop.

In accordance with another embodiment of the invention, a modular tabletop is provided, the tabletop having a base layer with at least one a portion removed therefrom to form a corresponding at least one opening having a predetermined shape; and a top layer having at least one portion removed to form a corresponding at least one opening having the predetermined shape and positioned to not overlap the at least one opening in the base layer.

In accordance with yet another embodiment of the invention, a modular table is provided, the table having a base layer having a circular plan form configuration with at least one crescent-shaped cutout; and a top layer having a circular plan form shape with at least one crescent-shaped cutout positioned to not overlap the at least one crescent-shaped cutout of the base layer.

In accordance with still yet another embodiment of the invention, a modular table system is provided, the system including a plurality of modular tables, each modular table having: a tabletop having at least one removable section that forms a corresponding at least one opening in the tabletop configured to receive a portion of another tabletop in butting relationship to form a larger tabletop; and a support structure to support the tabletop.

In accordance with yet another embodiment of the invention, a modular table system is provided having a plurality of tables, each table comprising a top having a circular plan form shape with at least one crescent-shaped cutout of same radius as the top; and a support structure to support the top.

In accordance with another aspect of the foregoing embodiment of the invention, a base is provided for supporting the top, the base having a circular plan form shape with at least one crescent-shaped cutout of same radius as the base and positioned below the top and on top of the support structure, the top positioned on the base so that the at least one cutout is positioned radially 90 degrees apart from the at least one cutout of the base.

As will be readily appreciated from the foregoing, the disclosed embodiments of the invention provide simple and cost-effective modular table units that can be utilized individually or matched together to form a larger table. Each modular table is a self-contained unit with no additional support legs, mechanisms, materials, or hardware that is required to complete the assembly of a larger table from the combination of multiple, identical modular table units. The use of a top and underlying base with matching cutouts or openings greatly improves the ease of forming a larger tabletop while increasing the structural integrity of the same without relying on additional hardware.

BRIEF DESCRIPTION OF THE SEVERAL VIEWS OF THE DRAWING(S)

The foregoing features and advantages of the present invention will be more readily appreciated as the same become better understood from the following detailed description when taken in conjunction with the accompanying drawings, wherein:

FIG. 9 is an isometric illustration of a further embodiment of the invention;

FIGS. 10A-10C are side views and FIGS. 10D-10E are top views of another embodiment of the invention;

DETAILED DESCRIPTION OF THE INVENTION

The modular table units of the present invention employ a multi-layer or multi-tiered tabletop design that may be molded, integrally formed, or constructed of individual components. The basic tabletop design can be divided into two horizontal planes bisecting an overall thickness of the tabletop. This basic tabletop design features two concave cutout sections of substantially the same size and shape, one situated on the upper horizontal plane and one situated on the lower horizontal plane. The concave upper and lower cutout sections are designed to facilitate assembling modular table units into a larger table by overlapping and interlacing individual table units. This is accomplished by correctly positioning the concave cutout section of one modular table unit in abutting relationship with the corresponding convex periphery of another modular table unit of the same design. Because the concave and convex portions are formed to have the same radius of curvature, the fit should be without gaps or spaces between these two sections of the tables.

Figure 1:
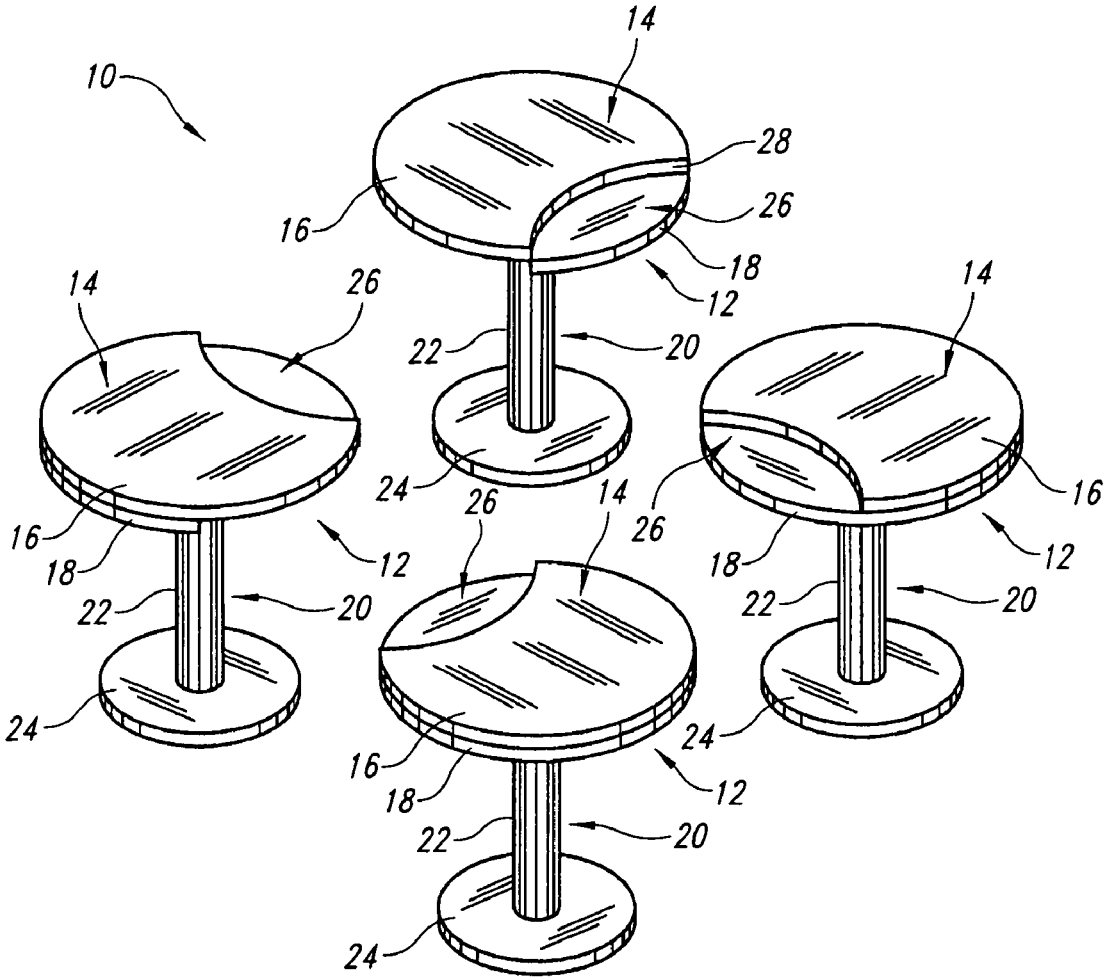
FIG. 1 is an isometric illustration of a modular table system showing the individual components prior to interlacing in accordance with the present invention.

Referring initially to FIG. 1, shown therein is a modular table system 10 formed in accordance with the present invention consisting of a plurality of tables 12 disengaged from one another. Each table 12 has a tabletop 14 that includes a top 16 formed on a base 18. A support structure 20 is located under the base 18 and, in this embodiment, includes a pedestal 22 resting on a stand 24. The stand 24 is sized and shaped to provide a stable support for the table 12 on a support surface, such as a floor, patio, deck, and the like.

Figure 2:
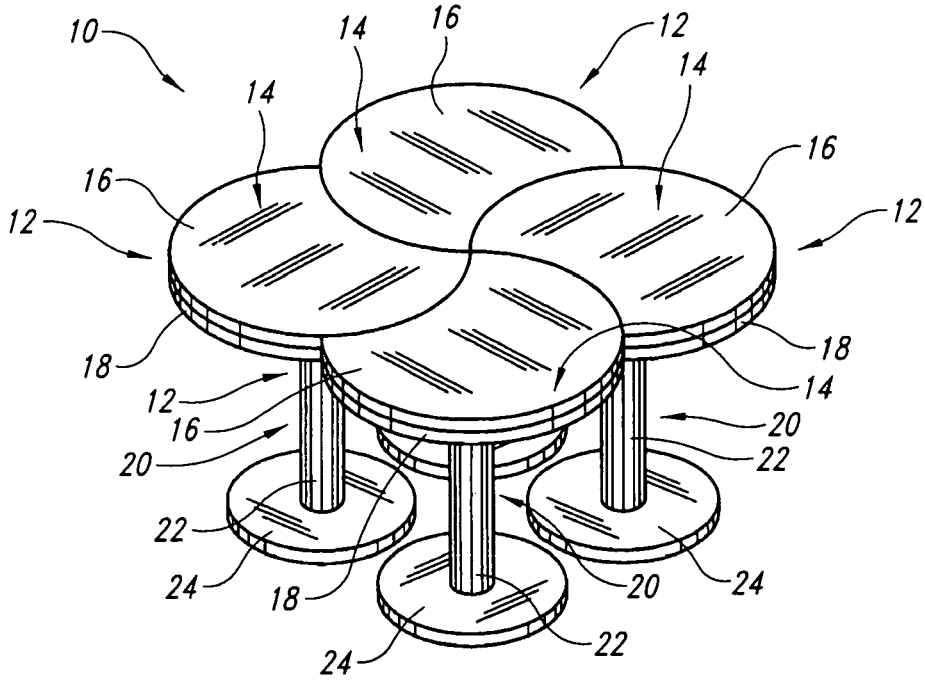
FIG. 2 is an isometric projection of the modular table system in the interlaced configuration to form a single enlarged tabletop from the four individual tabletops formed in accordance with the present invention.
Figure 5:
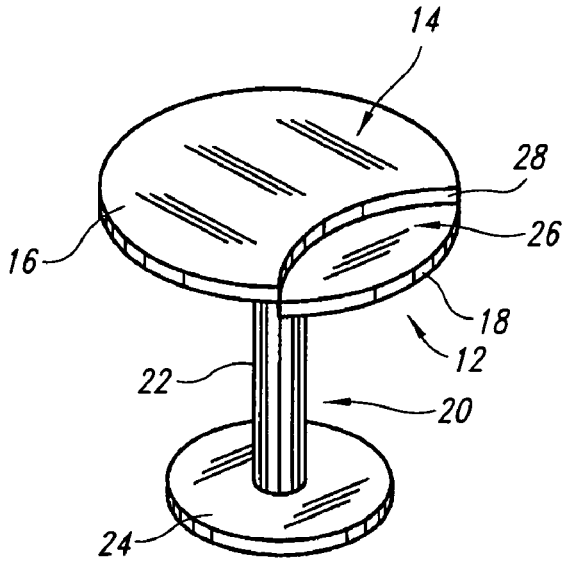
FIG. 5 is an isometric illustration of another embodiment of a modular table formed in accordance with the present invention.
Figure 6:
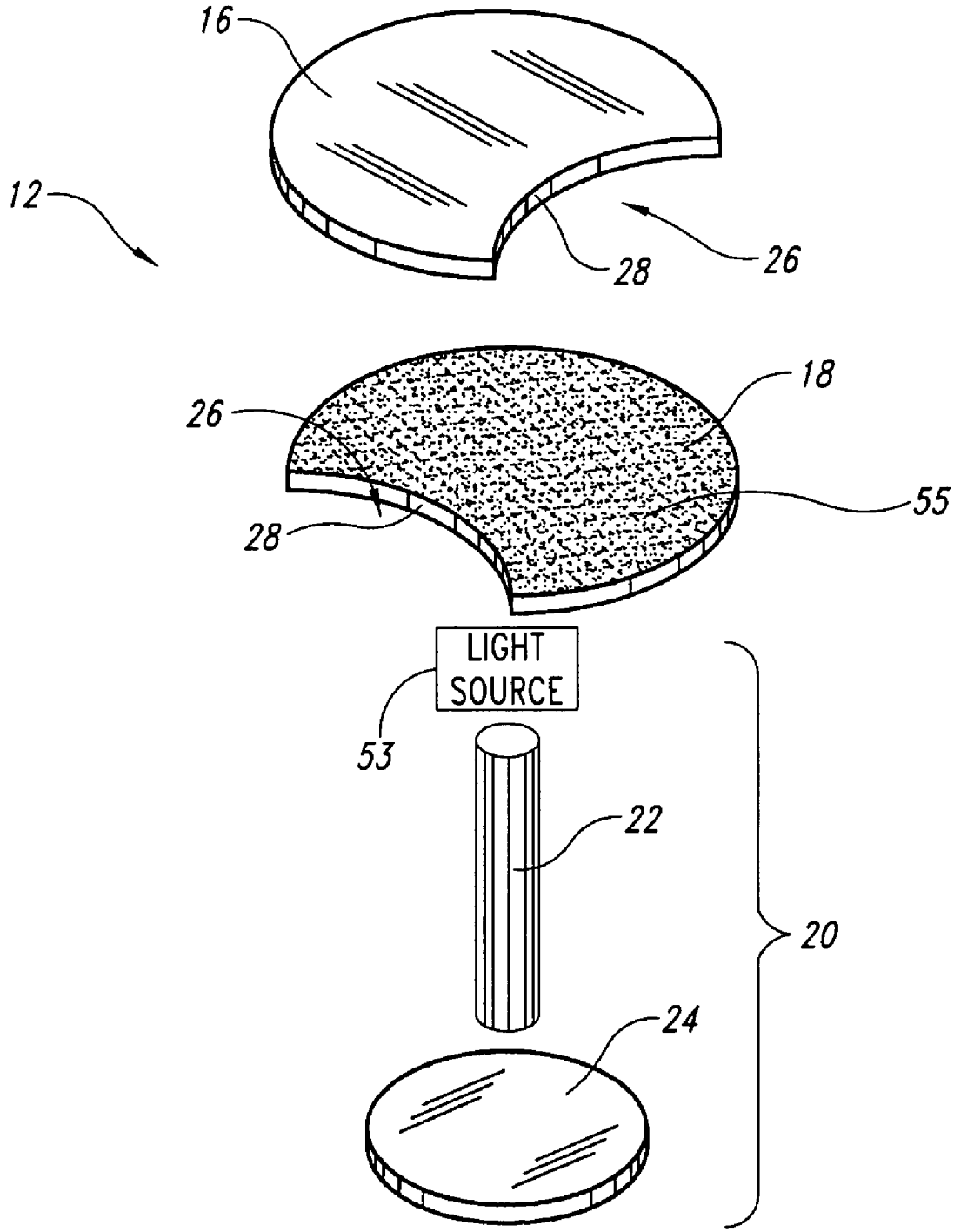
FIG. 6 is an exploded isometric projection of a modular tabletop formed in accordance with the present invention.

Each modular table 12 is configured to slide into engagement with at least one, and preferably two, adjacent tables, as shown in FIG. 2, to form a larger table. This is accomplished by forming each top 16 to have at least one removed section creating a concave open area 26 that is defined by a sidewall 28. In the embodiment shown in FIG. 5, both the top 16 and the base 18 have a circular plan form configuration and a crescent-shaped open area 26. Ideally, the radius of the open area 26 is the same radius as the circular top 16. Similarly, the base 18, as shown more clearly in the exploded view of FIG. 6, has the crescent-shaped open area 26 with arcuate sidewall 28 defined by a radius that is the same as the radius of the circular base 18. Ideally, the top 16 and the base 18 are of the same size and shape, with the top 16 having an exposed finish of a higher quality than that of the base 18.

When the top 16 is formed on the base 18, the concave open area 26 of the top does not overlap the open area 26 of the base 18. Ideally, the two open areas 26 are positioned radially 90 degrees apart when the top 16 and the base 18 are formed. This orientation allows two tables 12 to be interlaced at a 90-degree orientation to form a two-table modular table system 40 shown in FIG. 4. It is to be understood that other orientations are possible, such as 180 degrees, to form an enlarged table of the same width but extended length.

Each modular table 12 can interleave with two adjacent modular tables by simply sliding them together so that the open area 26 of the base 18 of a first table 12 is aligned with the open area 26 of the top 16 of an adjacent table 12. When the tables are slid together, the portion of the top 16 projecting over the open area 26 of the base slides into the open area 26 of the adjacent top 16. Similarly, the portion of the base 18 extending beneath the open area 26 of the top 16 slides into the open area 26 of the adjacent base 18 and under the projecting top 16. The interleaving of four tabletops 14 in this manner as shown in FIG. 2 yields a tabletop with an enlarged surface area that is supported by four supporting structures 20. This arrangement achieves the same or greater stability as a table of the same size with four legs. It is to be understood that while the base 18 component could be eliminated and only the top 16 be used, it may be necessary to use mechanisms such as latches or other similar devices to hold the tops 16 into engagement. In the configuration that uses the multi-layer combination of the base 18 and the top 16, such retention mechanisms may not be necessary although they could be used if desired.

Figure 3:
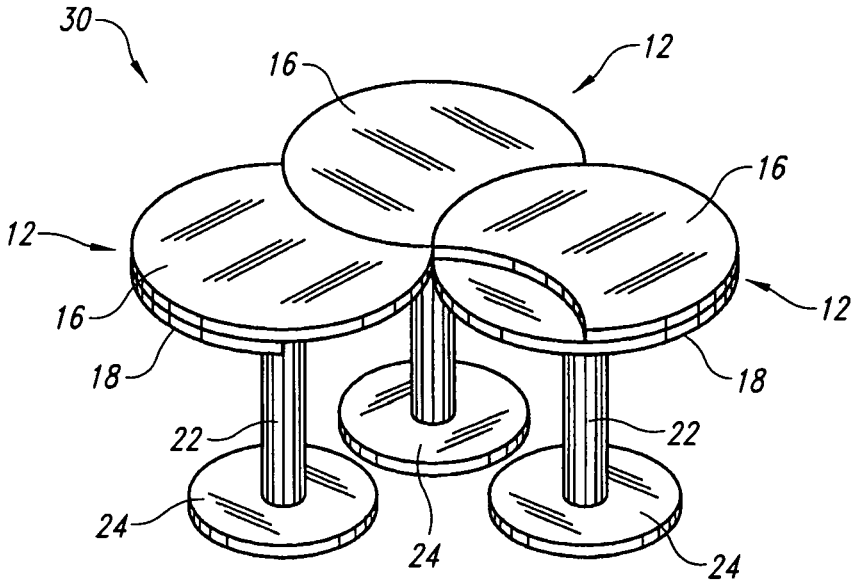
FIG. 3 is an illustration of an alternative embodiment of the invention utilizing three modular tabletops interlaced to form a single enlarged tabletop.
Figure 4:
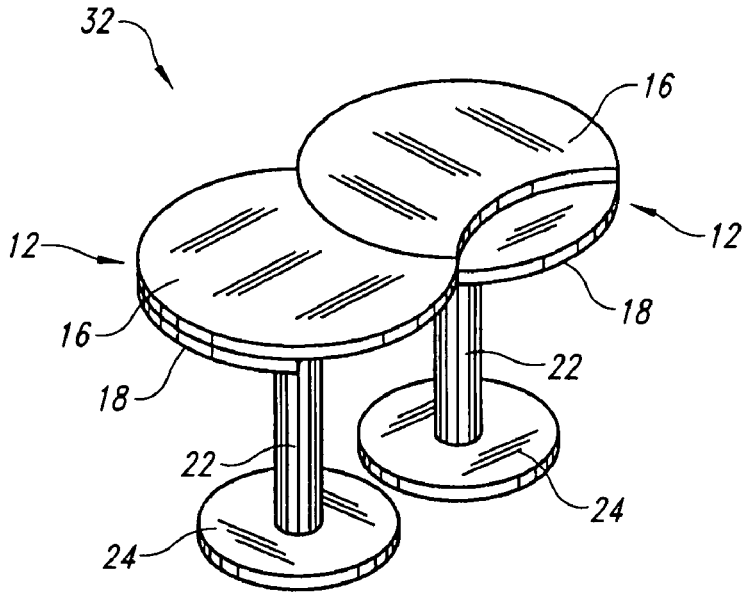
FIG. 4 is an isometric projection of a modular table system formed in accordance with another embodiment of the invention wherein two modular tables are interlaced together to form an enlarged tabletop.

The modular design of the table 12 yields itself to other combinations, such as those shown in FIGS. 3 and 4 wherein the modular table system 30 of FIG. 3 utilizes three tables 12 and the modular table system 32 of FIG. 4 utilizes two tables. When less than four tables are used, the unused open area 26 can be filled in with a matching section to present a uniformly planar top surface.

Figure 7A:
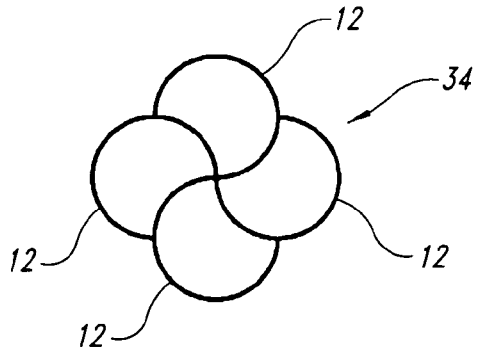
FIGS. 7A-7J are top plan form views of alternative modular table system designs formed in accordance with the present invention.
Figure 7B:
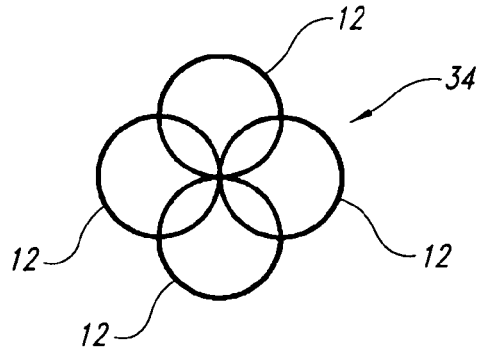

It is also to be understood that table shapes other than the circular plan form configuration can be used in accordance with the teachings of the present invention. For example, shown in FIGS. 7A-7J are alternative designs or orientations of modular table systems. In the modular system 34 shown in FIGS. 7A-7B, the top 16 is positioned on the base 18 so that the top 16 is radially 180 degrees different than the orientation of the top 16 on the base 18 of the modular table 12 shown in FIGS. 1-6. FIG. 7B shows, without phantom lines, the positioning of each table 12 with respect to the other tables 12. While the ultimate result is the same, the pattern formed by the intersecting sides is a mirror image of that shown in the top plan view of FIG. 7A.

Figure 7C:
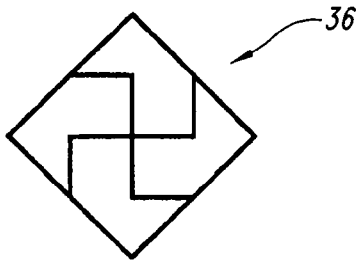
Figure 7D:
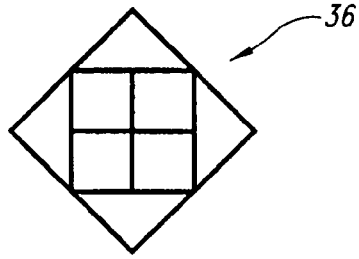
Figure 7E:
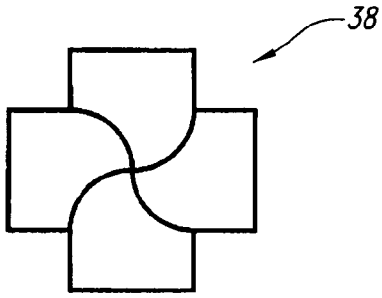
Figure 7F:
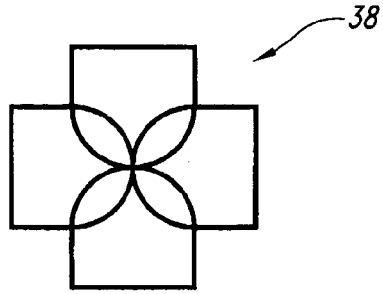
Figure 7G:
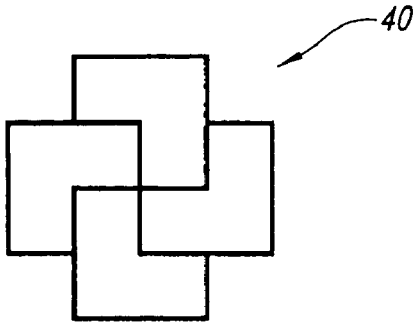
Figure 7H:
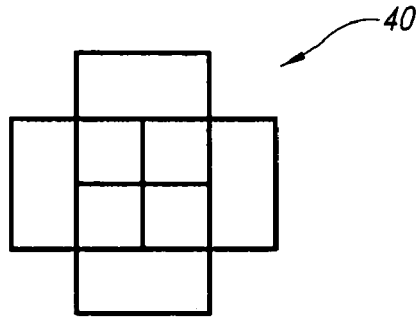
Figure 7I:
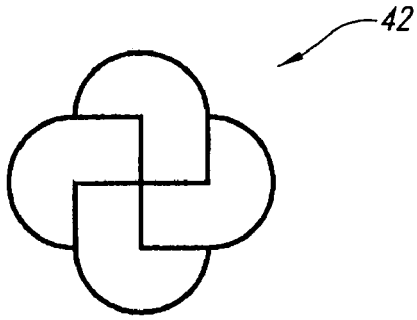
Figure 7J:
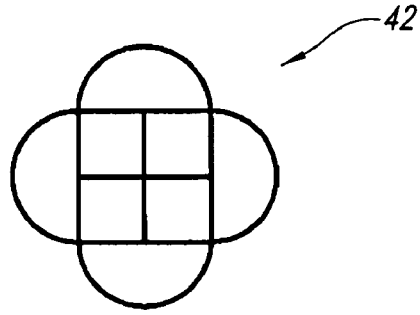

FIGS. 7C-7J show alternative designs utilizing the principles of the present invention. In each design, approximately a quarter of the tabletop 16 is removed as is a quarter of the base 18, with the top 16 and base 18 positioned to permit interlacing or interleaving of at least one, and preferably two, adjacent tables. The modular table system 36 in FIGS. 7C and 7D shows tabletops with triangular edges. FIGS. 7E and 7F show a modular table system 38 with tables having a combination of arched and straight sided tabletops. The modular table system 40 shown in FIGS. 7G and 7H illustrates tabletops shaped in the form of squares. FIGS. 7I and 7J show the modular table system 42 with the tabletops shaped reverse to those shown in FIGS. 7E and 7F. It is to be understood that other designs are also possible that use tabletops of various other shapes, such as those with other polygonal edges.

Figure 8A:
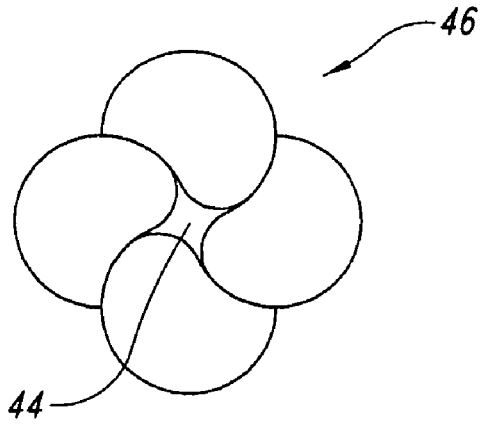
FIGS. 8A-8C are top plan form views of alternative embodiments of modular table systems formed in accordance with the present invention.
Figure 8B:
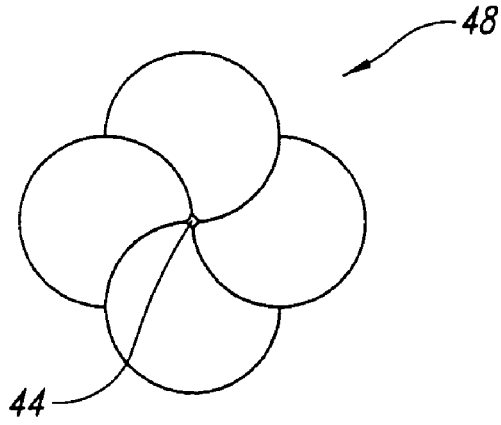
Figure 8C:
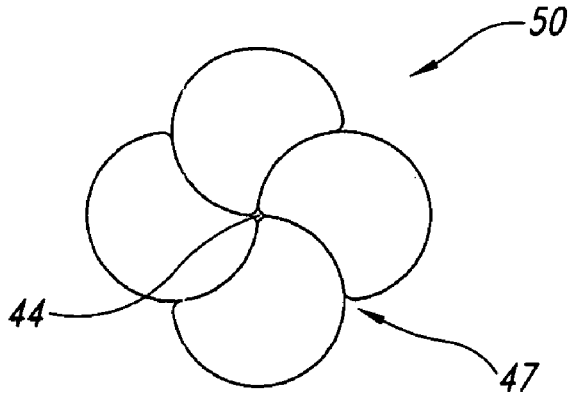
Figure 10D:
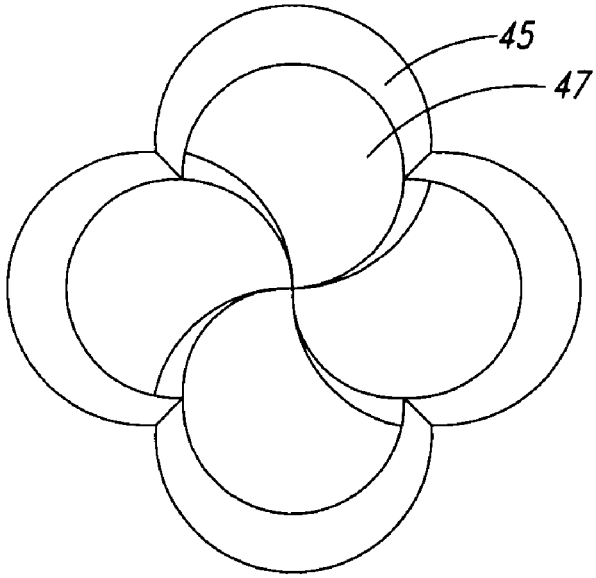
Figure 10E:
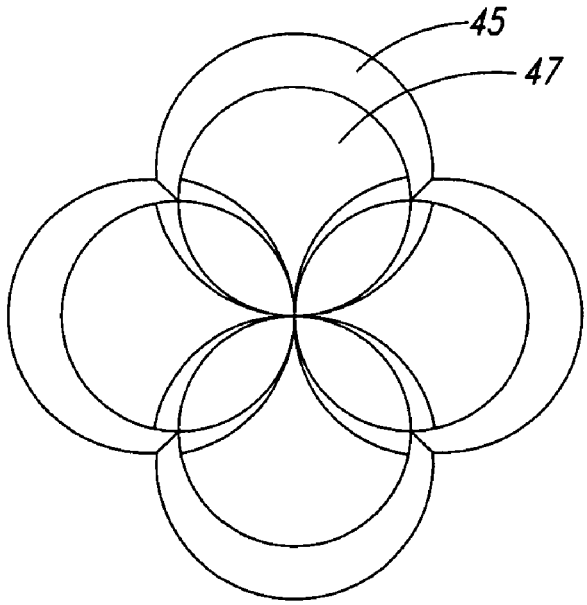

Other variations are also possible, as shown in FIGS. 8A-8C. Here, a center opening 44 is provided to enable the use of a table umbrella on a pole (not shown) which is inserted through the opening 44 and supported by a base (not shown). Planting pots, serving trays, and the like may also be mounted or placed in the opening 44 depending upon its size. More particularly, in FIG. 8A, an enlarged opening 44 is created in the modular system 46 shown therein by shaping the tabletop to have a teardrop or kidney shape.

The modular table system 48 shown in FIG. 8B utilizes a circular tabletop 16, while the tabletop 16 shown in the modular table system 50 of FIG. 8C is more rounded on the corners 47 of the open area, which provides for the opening 44.

The modular tables 12 shown and described herein can be constructed using known techniques and materials that are currently available on the marketplace. While the general design of each modular table 12 is shown divided into three broad components, the top 16, the base 18, and the support structure 20, it is to be understood that actual construction or assembly methods may not be limited to or be required to adhere to these component categorizations and descriptions.

For example, the stand 24 on which the pedestal 22 is mounted should be designed and constructed with consideration for the overall dimension of the tabletop 14. In other words, the stand 24 should be broad enough and constructed of heavy enough material to support the table's overall structural requirements and to prevent unwanted lateral movement, i.e., tipping. While the shape and design of these stands, and for that matter the pedestal 22, is not restricted, special care should be taken so that neither the design nor the material interferes with the assembly of the modular tables 12 into the system configuration.

The preferred construction of the pedestal 22 is of a single vertical shaft of sufficient thickness to support the modular table's overall structural requirements. For example, if the tabletop 14 is granite or steel, this mandates the use of sturdier materials for the pedestal 22 than if the tabletop were constructed of extruded synthetic material. While the preferred method of attaching the pedestal 22 to the tabletop 14 is by industrial-grade stainless steel screws, such as 10-24 by 1 inch, or similar, it is to be recognized by those of skill in the art that other screw sizes, materials, and fastening or attaching devices or techniques may be readily substituted as desired. Alternatively, the present invention may be constructed as a single integrated unit, requiring no attaching hardware.

As noted above, the basic design of the tabletop 14 can be divided into two horizontal planes or layers, the top 16 and the base 18, each plane or layer featuring an area roughly equal to one-quarter of the overall surface area of the modular system 10. The open area 26 formed of a concave reversed-order circumference is of substantially the same size and shape. While the modular tables 12 are intended for matching together with modular tables 12 of identical construction and style, it is to be understood that the designs in general may vary in shape and dimension as described above.

It is to be appreciated that while a preferred embodiment of the invention has been illustrated and described along with numerous variations therein, the examples illustrated and described herein do not represent the complete range of variations in shape nor are they intended to limit the scope of the accompanying claims.

In accordance with another embodiment of the invention, the tabletop 16 can have the open area 26 filled in by a removable section so that when the table 12 is used alone, the entire surface area is available for use. The removable section can be attached by hinges or other devices that allow it to remain attached to the top 16 or to the base 18, or it can be dropped down when the top 16 is used without the base 18. In other words, the removable section can slide down at least a distance equal to the thickness of the top 16 and remain in place to provide a supporting shelf for an adjacent table that is interleaved with the modified table 12. The mechanics and method of insertion can include, but are not limited to, a spring-loaded removable section that retracts with external pressure and extends to its original position when the pressure is released; or a sliding leaf that relies on fabricated tracks, rollers, or other means to successfully retract into the body of the modular table.

In another embodiment of the invention, the removable section can contain or be constructed of a material that provides some degree of illumination.

In addition, the overall support structure for the modular table 12 can be achieved by means of novel, unique, or distinctive support structures and materials that may include, but are not limited to, fashioned wrought iron, transparent columns or pedestals filled with some material for the purpose of decoration, education, or advertising, or the use of wood, mixed construction media, and the like.

The design and functional features described herein can also be applied to non-pedestal table supports and to other articles of furniture, such as ottomans, footstools, and day beds. FIG. 9 illustrates a design 31 in which a lower section 33 having an open section 35 provides support for an upper section 37 that has an open section 39. As such, this design 31 is configured to interleave with other designs 31 in the manner described above with respect to the other embodiments of the invention.

Shown in FIGS. 10A-10E are illustrations of another alternative embodiment of a tabletop 41 supported on an underlying base 43 wherein the side surfaces 45 of the top 41 and the base 43 are not orthogonal to the adjacent top surfaces 47, 49, respectively. In other words, the side surfaces 45 may be rounded, angled, such as at 45 degrees, or both rounded and angled, either at their intersection with the top surfaces 47, 49 or along the entire side surface 45.

In accordance with another embodiment of the invention, the entire top or base, or both, or portions thereof, may be formed of either transparent or translucent material that admits light there through. A source of illumination 52 shown in FIG. 6 as a generic black box, such as a light bulb powered by batteries, AC house current, or solar panel, may be included, preferably mounted in the top or the base or both, or mounted below the top or below the base, such as in the support structure. The transparent or translucent material may be clear or formed of tinted material 54 to provide viewable colors. Alternatively, the top may be one color and the underlying base may be another color such that when the top and base overlap at the cutout portions, a third color is visible.

In yet another embodiment of the present invention, the tabletop may be formed to have multiple removable sections or open areas. For example, shown in FIGS. 11A-11C are alternative top and base embodiments with multiple open areas.

Figure 11A:
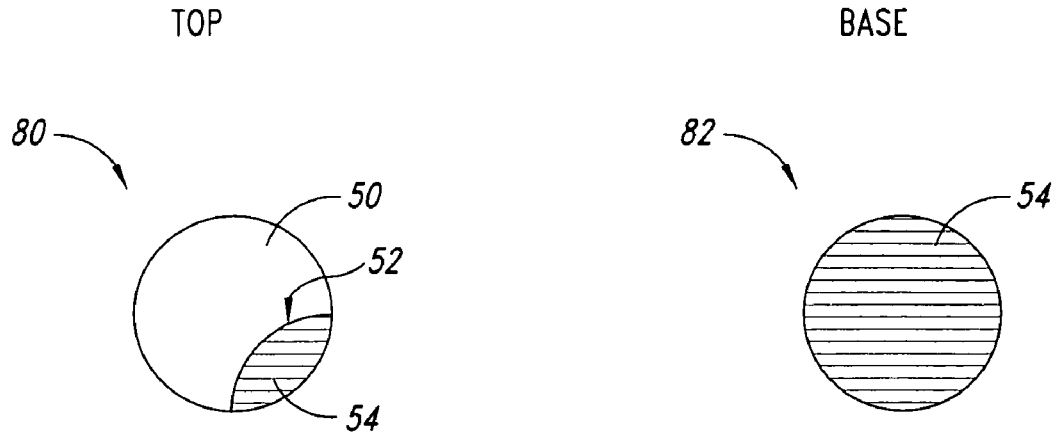
FIGS. 11A-11C are top plan form views of alternative top and base embodiments of modular tables formed in accordance with the present invention.

More particularly, in FIG. 11A, a table 80 is shown in which a top portion 50 has an opening 52 formed therein, and the base portion, shown here separately with reference number 82, is solid and has no openings formed in its body 54.

Figure 11B:
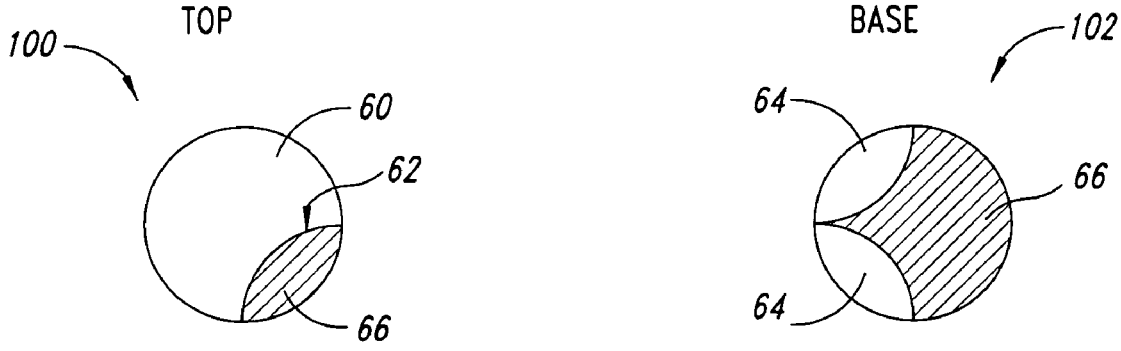
Figure 11C:
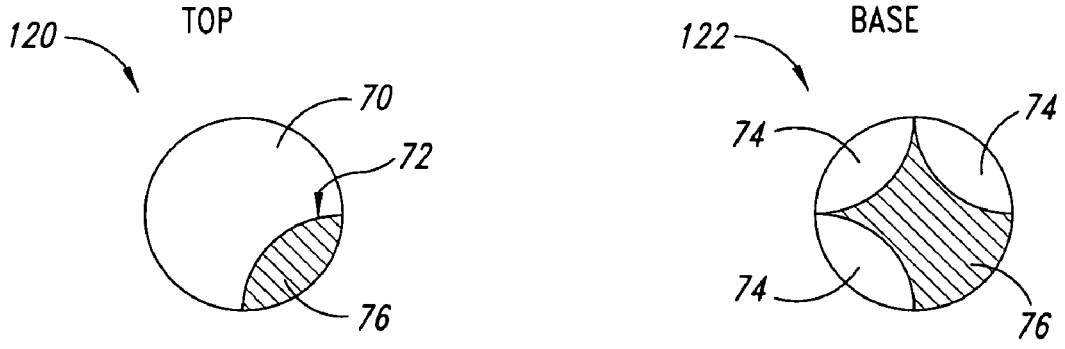

Shown in FIG. 11B is a tabletop 100 with a crescent-shaped top portion 60 and a single cutout or open area 62. A base 102 has a base portion 66 with two open areas 64. In one embodiment, the top 100 and the base 102 can be used as a part of a modular table that interleaves with other modular tables to form a system of modular tables. For example, a modular table using tabletop 100 having base 102 can interleave with another modular table with the same top and base design or it can be used in combination with other modular tables using different top and base designs, such as a modular table that employs a base 82 with a single crescent-shaped open area 56. It is to be understood that multiple open areas of different shapes are also possible, such as the shapes shown in FIGS. 7C-7J.

Similarly, shown in FIG. 11B is a tabletop 120 with a crescent-shaped top portion 70 and a single open area 72, similar to the one discussed above in conjunction with FIG. 11A. A base 122 has a base portion 76 with three cutouts or open areas 74. In one embodiment, the top 120 and the base 122 can be used together to form a modular tabletop that interleaves with other modular tabletops of the same design and number of cutouts or in combination with other modular tabletops using different top and base designs and number of cutouts to form a system of modular tables. For example, a modular table with the top 100 and base 102 illustrated in FIG. 11B can be interleaved with a modular table having a top 120 and base 122 shown in FIG. 11C in which the base 122 has two cutouts 64.

Figure 12A:
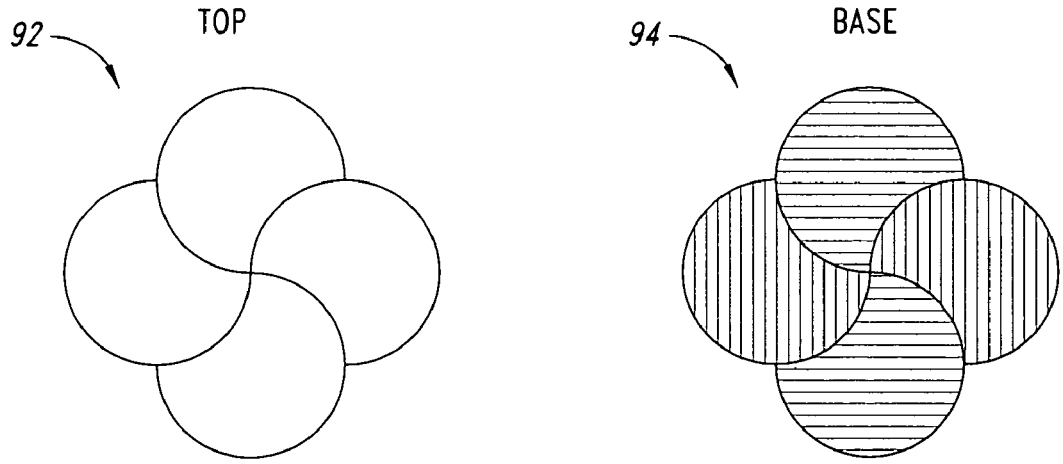
FIGS. 12A-12C are top plan form views of modular table systems formed with the tops and bases illustrated in FIGS. 11A-11C.
Figure 12B:
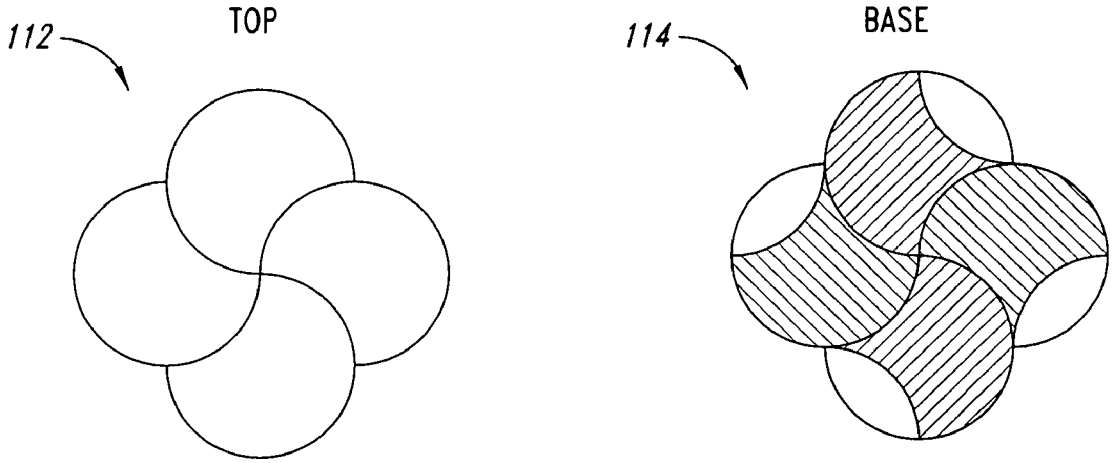
Figure 12C:
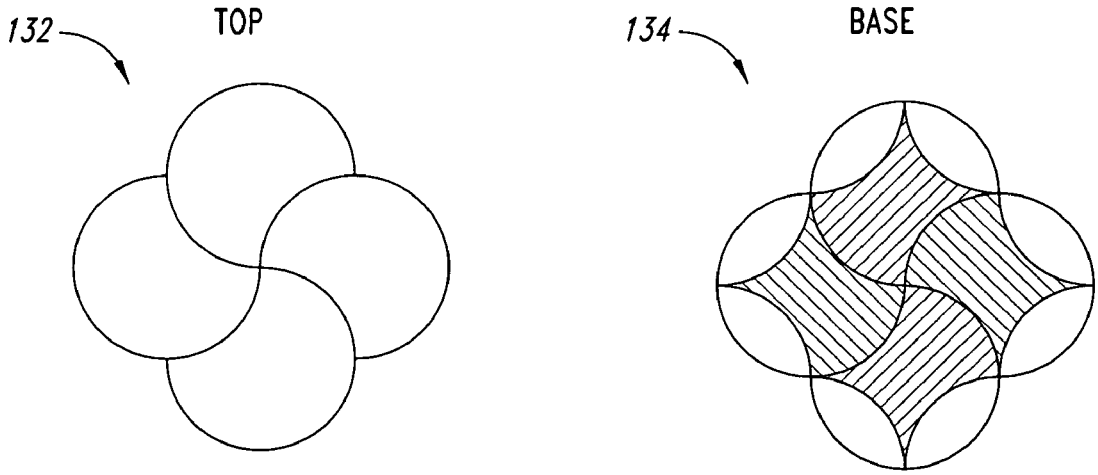

Shown in FIGS. 12A-12C are top plan vies of tabletops of FIGS. 11A-11C interleaved together to form a modular system of four tables. Each figure demonstrates the ability of the various designs of FIGS. 11A-11C to interleave together to form the same modular system. For example, FIG. 12A shows the interleaving of four tabletops from FIG. 11A, with the bases 94 shown in a top view to the right. FIG. 12B shows the interleaving of four tabletops 112 with corresponding bases 114, each tabletop consisting of the top 100 and the base 102 that has two cutouts 64. Similarly, shown in FIG. 12B are four tops 132 with corresponding bases 134, each tabletop consisting of the top 120 and the base 122 that has three cutouts 74.

The modular design of the tabletops using bases 82, 102, and 122 lend themselves to other combinations, such as those shown in FIGS. 13A-13E and 14A-14F.

Figure 13A:
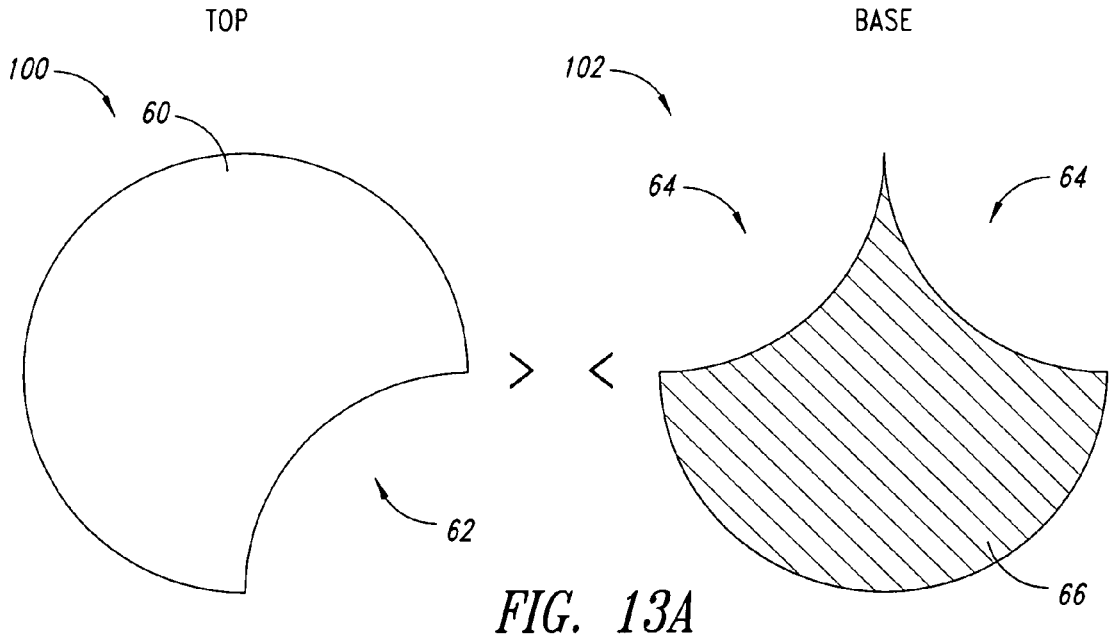
FIGS. 13A-13E are top plan form views of one embodiment of the modular table system formed in accordance with the present invention.
Figure 13B:
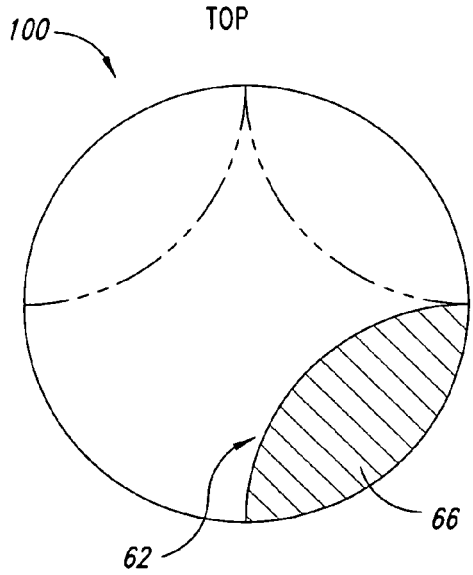
Figure 13C:
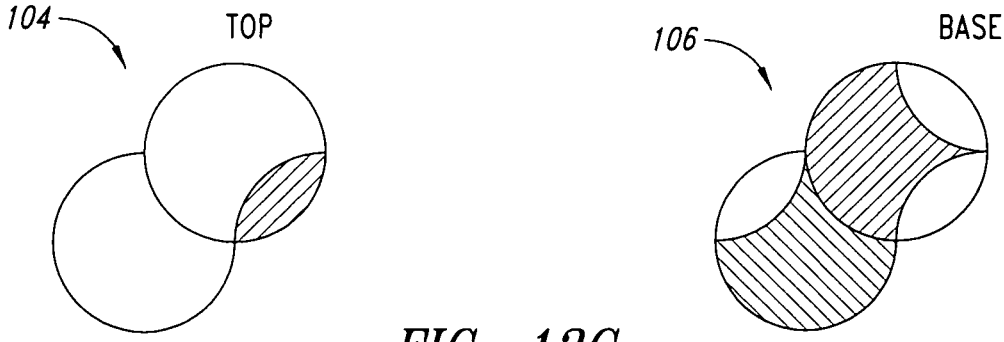
Figure 13D:
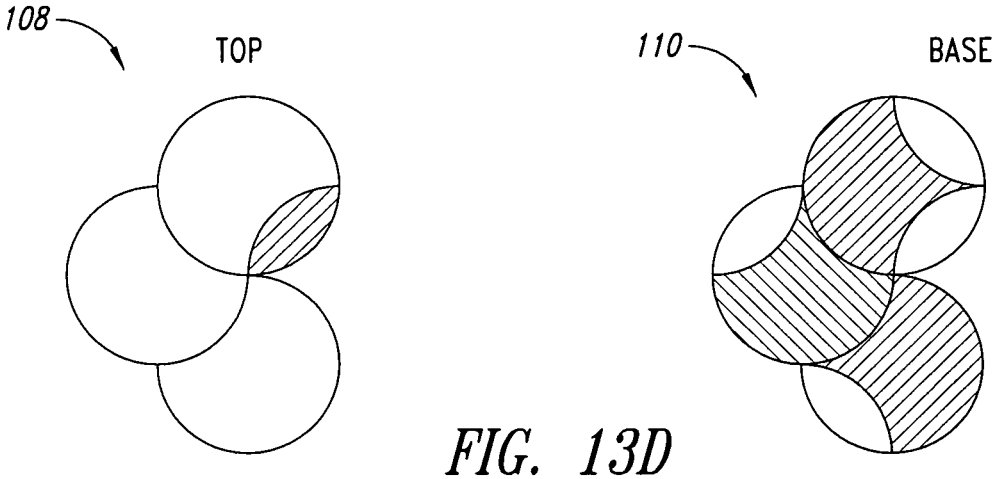
Figure 13E:
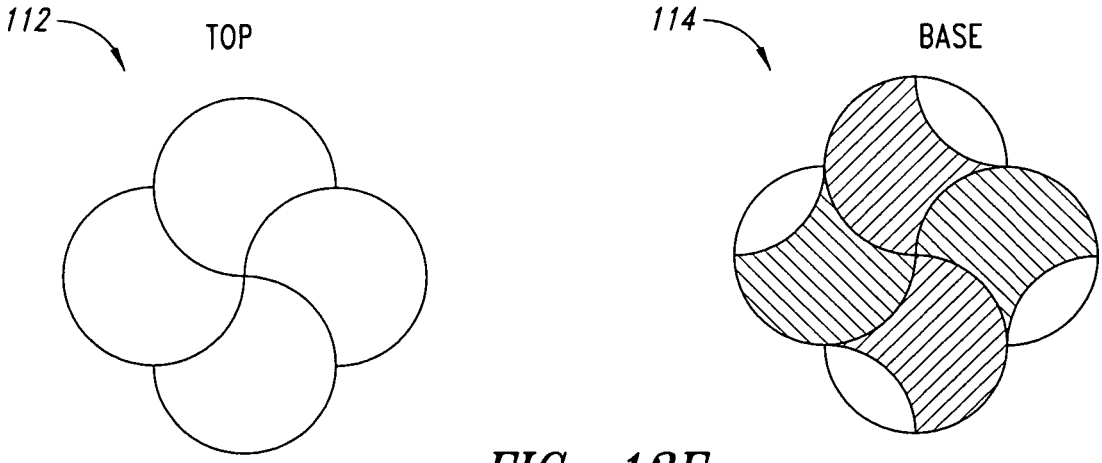
Figure 14A:
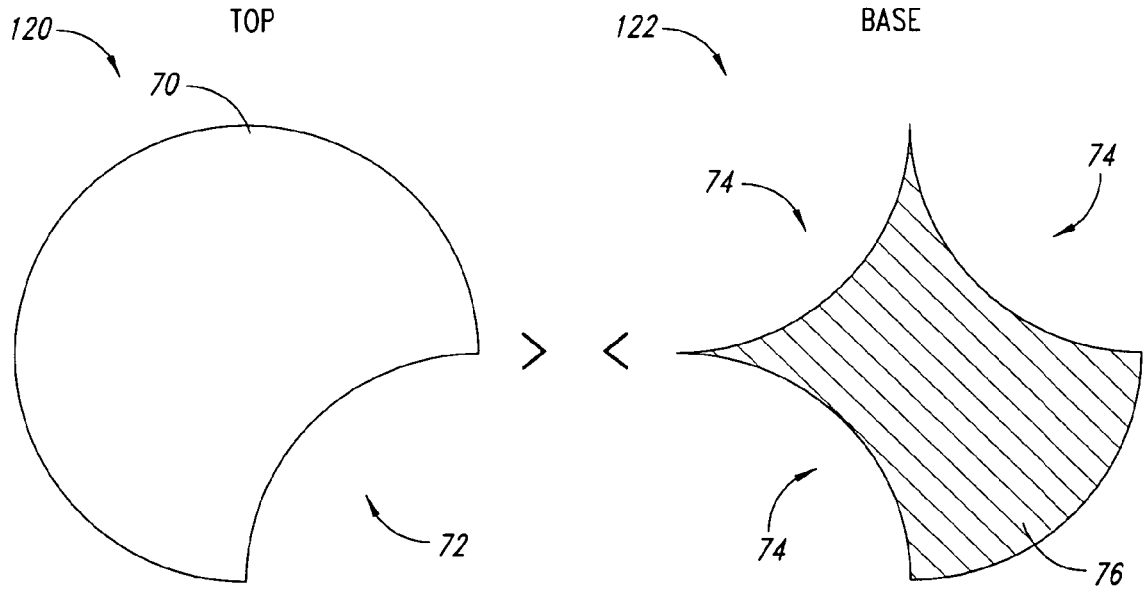
FIGS. 14A-14E are the top plan form views of an alternative embodiment of the modular table system formed in accordance with the present invention.
Figure 14B:
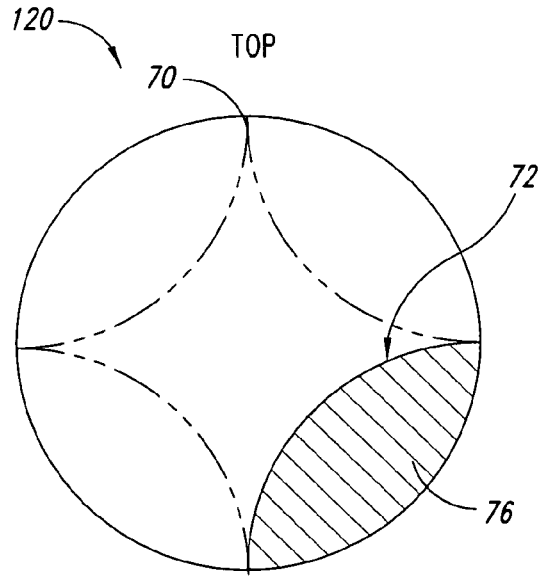
Figure 14C:
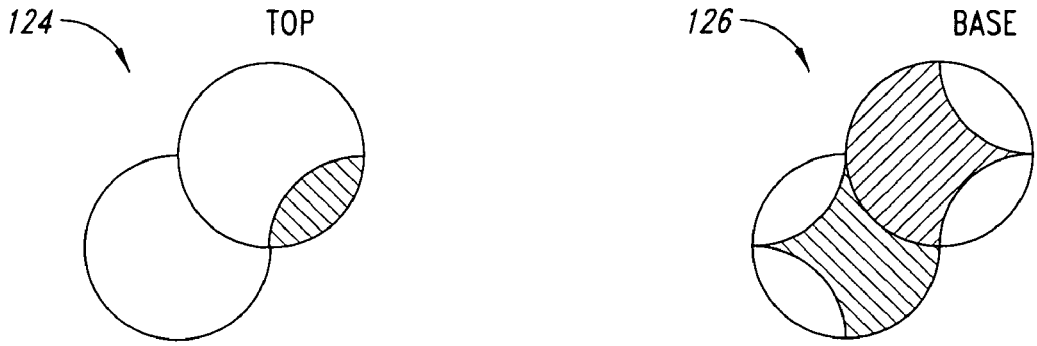
Figure 14D:
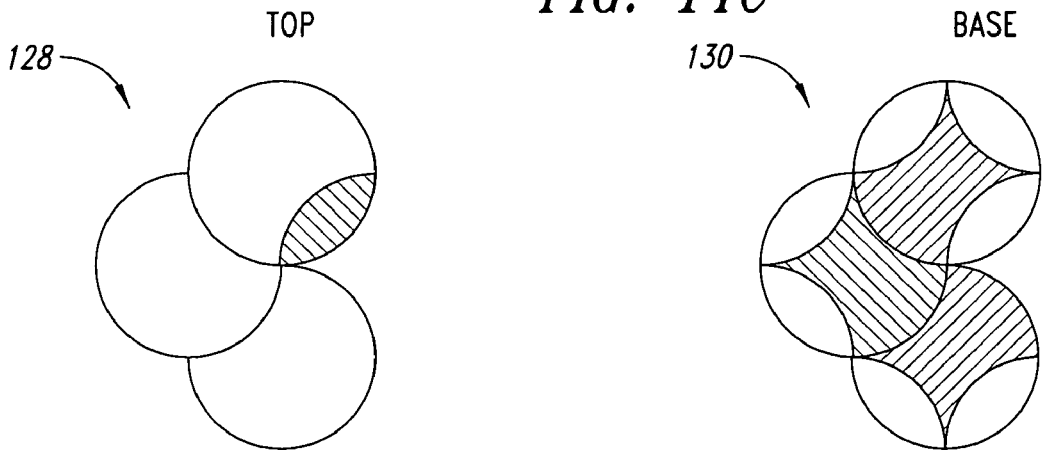
Figure 14E:
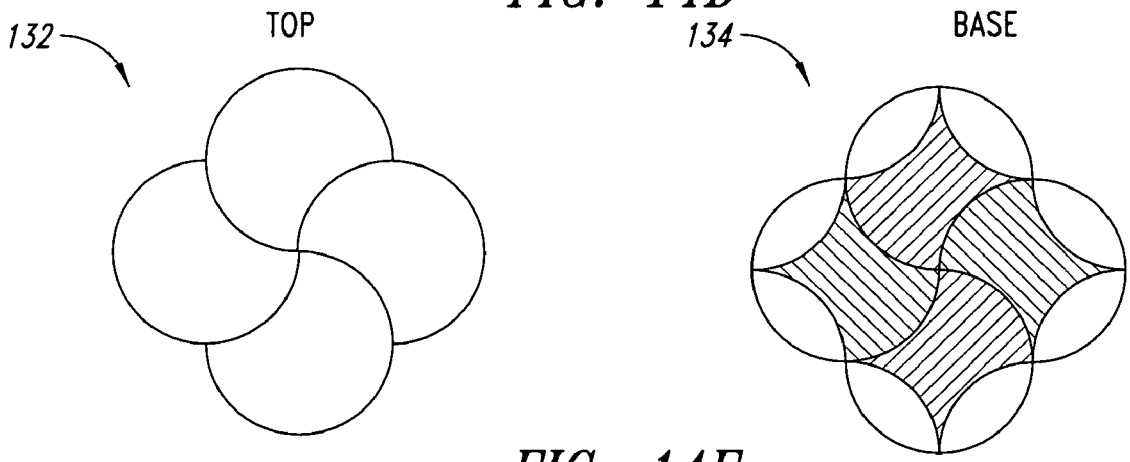

As shown in FIGS. 13A and 13B, the top 100 and base 102, which has two cutouts 64, can be interleaved with other top and base portions to form a system of tabletops 104, 108, and 112 and corresponding tables as shown in FIGS. 13D-13E. Each tabletop system also has a matching interleaved base system 106, 110, and 114. In another embodiment as shown in FIGS. 14A and 14B, the top 120 and base 122, with three cutouts 74, are interleaved with other top and base portions forming tabletop systems 124, 128, and 132 as shown in FIGS. 14C-14E. The tabletop systems also have corresponding base systems 126, 130, and 134.

The four tabletop systems 92, 112, and 132 as shown in FIGS. 12A-12C with corresponding base systems 94, 114, and 134 can be combined with other tabletop systems that use a different number of cutouts on the base, such as two cutouts 64 or three cutouts 74, to form multiple combinations of modular tabletops, and hence table systems, as shown in FIGS. 15A-15E and 16A-16N.

Figure 15A:
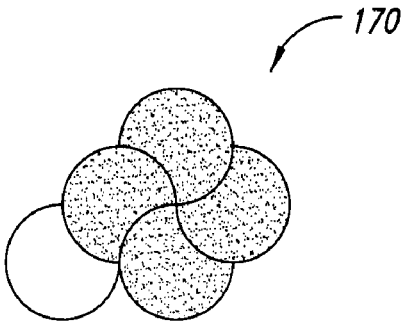
FIGS. 15A-15E are top plan form views of alternative embodiments of modular table systems formed in accordance with the present invention.
Figure 15B:
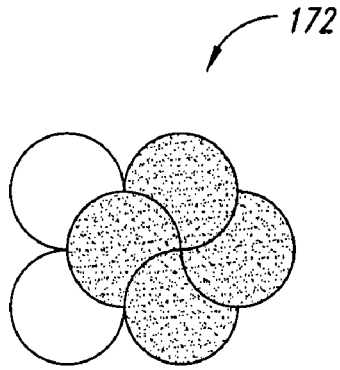
Figure 15C:
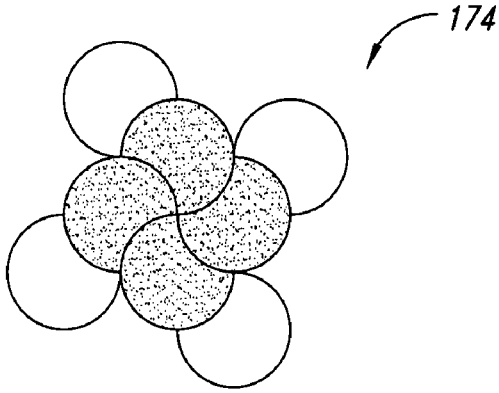
Figure 15D:
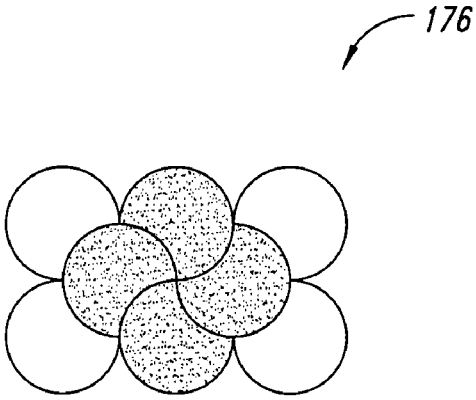

FIG. 15A shows the modular table system 170 consisting of a core of four modular tables joined together, such as system 92, 112, or 132, with a single table connected to one of the available tables. It is to be understood that the connected table can connect to any one of the available four tables as desired. As such, FIG. 15B shows the modular table system 172 consisting of the core of four tables and two adjacent tables attached to one side of the core. In another embodiment, the core of four tables can be joined together with four tables positioned on alternative available sides of the core tables to form the modular table system 174 as shown in FIG. 15C. In FIG. 15D, two pairs of adjacent tables are connected or engaged to a core of four tables to form the modular table system 176.

Figure 15E:
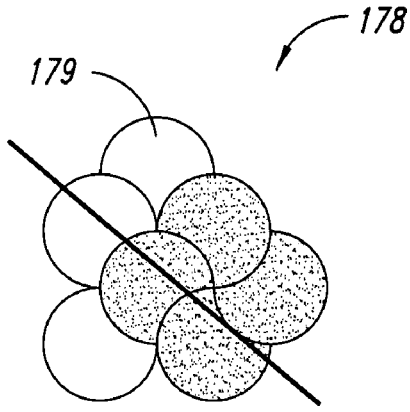

In another embodiment, the core of four tables is attached to two adjacent tables and a third table with tabletop 179 with two cutouts on the top portion to form the modular table system 178 as shown in FIG. 15E. In this embodiment, the third tabletop 179 with two cutouts on the top portion is attached to a base that has no cutouts (not shown). Alternatively, the tabletop 179 is attached to a base with either one or two cutouts but aligned in such a way that the cutouts of the base are not aligned with the two cutouts of the top.

Figure 16A:
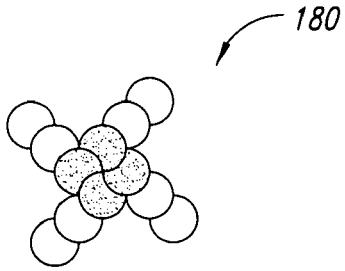
FIGS. 16A-16N are top plan form views of other alternative embodiments of the modular table systems formed in accordance with the present invention.
Figure 16B:
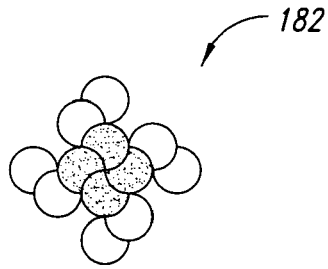
Figure 16C:
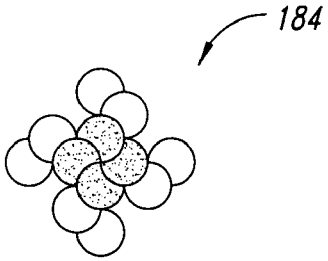

As discussed earlier, the FIGS. 16A-16N further show alternative embodiments with multiple modular tables attached to the core of four tables with tabletops that can consist of any of the combination of tabletops shown in FIGS. 12A-12B. For example, the core of four tables can be joined with four sets of tables linked in pairs to form the modular table system 180 as shown in FIG. 16A. FIGS. 16B and 16C show the modular table systems 182 and 184 that are a variation of the table system 180 in that the four sets of tables are not linked in the same direction but rather the four sets of tables are joined at different sides to form the different patterns shown.

Figure 16D:
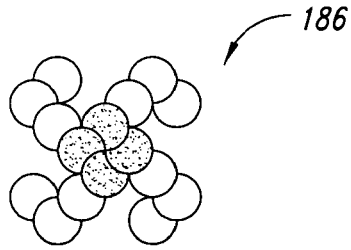
Figure 16E:
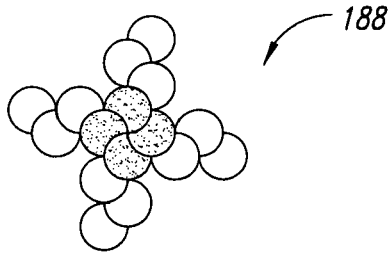
Figure 16F:
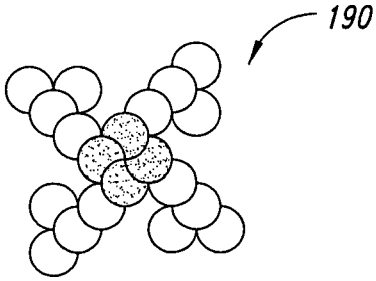
Figure 16G:
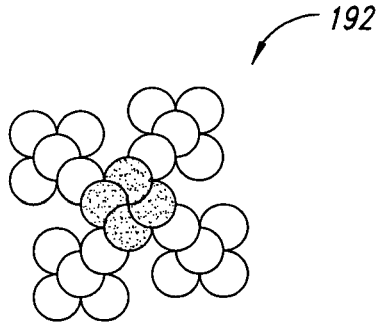

The same design can be repeated to form the modular table system 186 or 188 with four sets of tables linked in a chain of three tables with an addition of a single table at the end of the chain as shown in FIGS. 16D and 16E respectively. The same chain can be constructed with an addition of two or three tables at the end of the chain to form the modular table system 190 and 192 respectively as shown in FIGS. 16F and 16G.

Figure 16H:
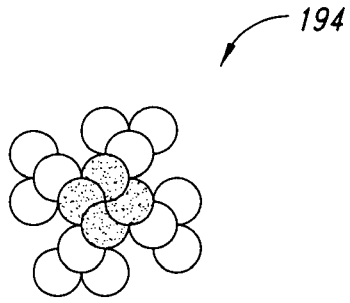
Figure 16I:
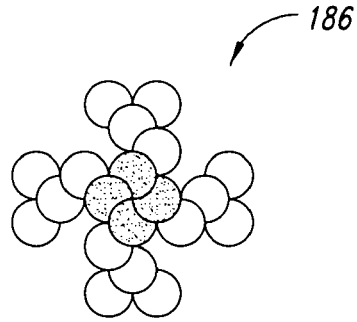
Figure 16J:
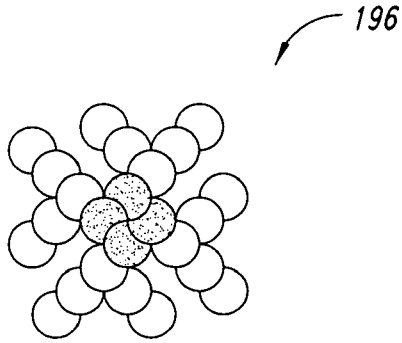
Figure 16K:
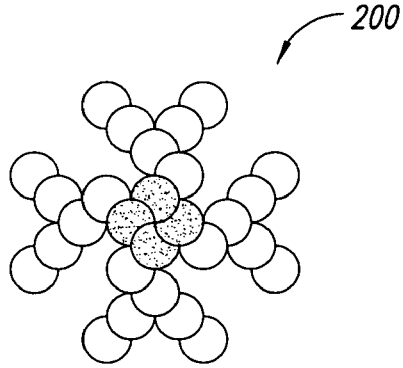
Figure 16L:
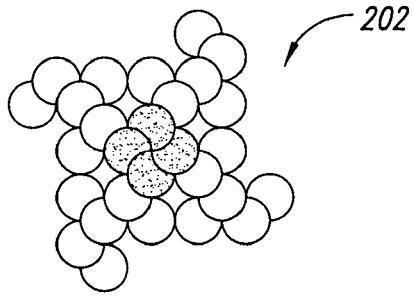
Figure 16M:
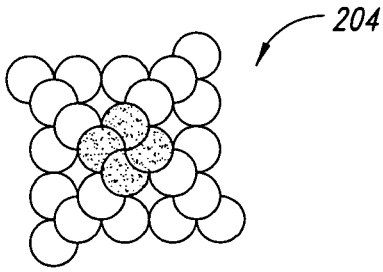
Figure 16N:
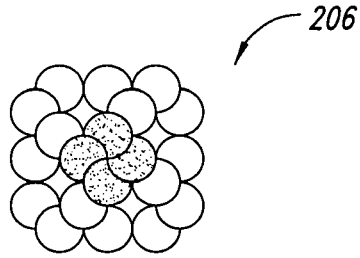

Similarly, the core of four tables with matching tabletops can be interleaved with four sets of tables having corresponding three tabletops to form the modular table system 194 as shown in FIG. 16H or to form the modular table system 196 shown in FIG. 16I. The embodiments discussed can further be expanded to form various other embodiments with multiple tabletops formed as branches from a nucleus of four tables, such as a modular table system 198, 200, or 202 as shown in FIGS. 16J-16L respectively. In some embodiments, the modular table system can begin to take a more circular shape, such as the system 204 in FIG. 16M or the system 206 in FIG. 16N.

It is to be understood that the embodiments discussed above are only examples of the different designs and patterns that can be formed with different modular tabletops, such as tops 80, 100, 120 shown in FIGS. 11A-11C.

Figure 17B:
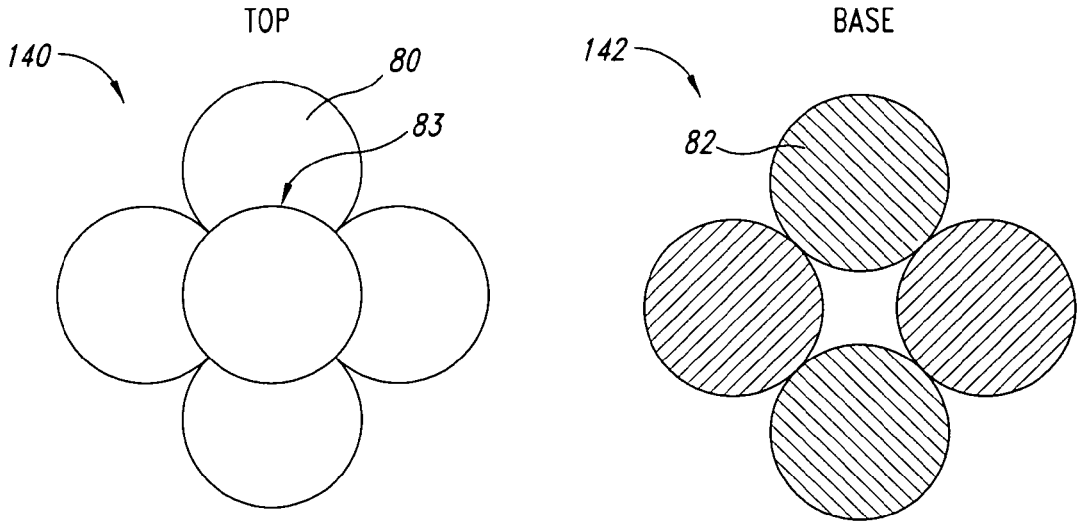
FIGS. 17A-17C are top plan form views of an alternative embodiment formed in accordance with the present invention.
Figure 17C:
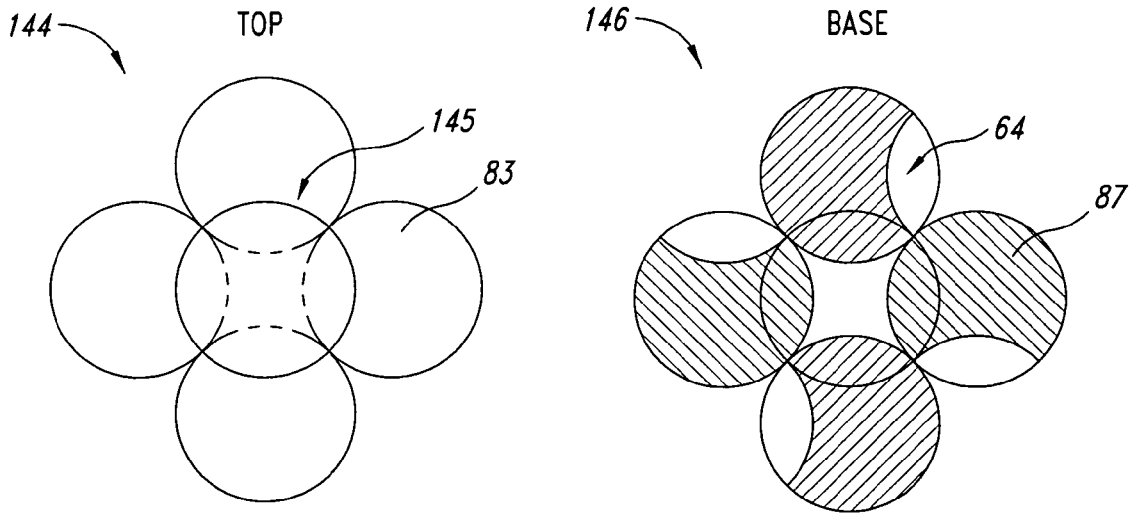
Figure 17A:
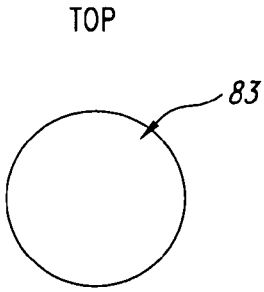

In another modular system 140, 142 shown in FIGS. 17A-17B, four tops 80 with a single cutout and corresponding bases 82 with no cutout can be joined together as shown in FIGS. 17A and 17B by a using a circular center table 83 having a whole top and no base piece. Alternatively, as shown in FIG. 17C the peripheral tabletops can have a base 87 with at least one cutout 64 or with multiple cutouts or open areas 64 in a similar manner as described above to enable additional tables to be added into the system 144, 146.

Figure 18B:
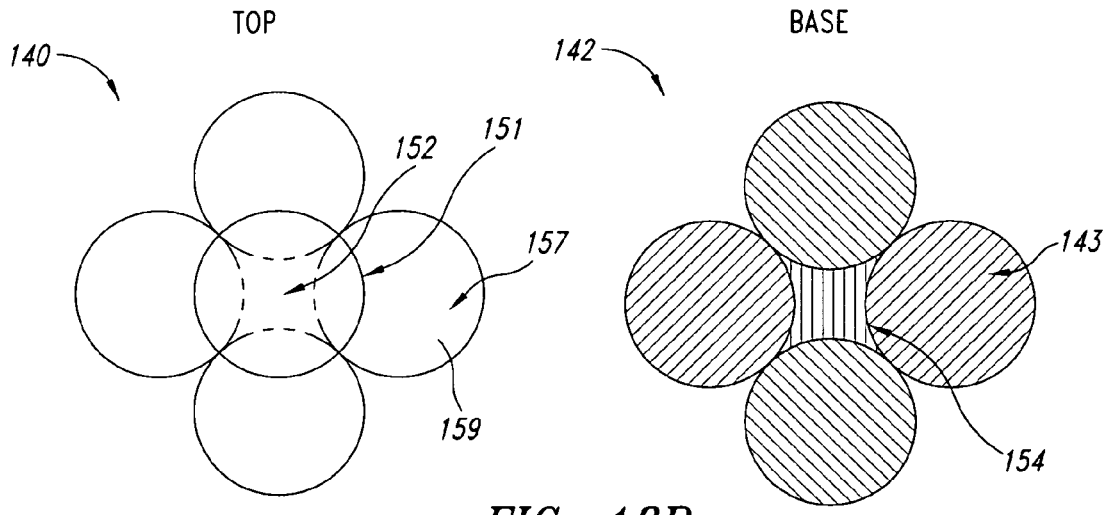
FIGS. 18A-18C are top plan form views of another alternative embodiment formed in accordance with the present invention.
Figure 18C:
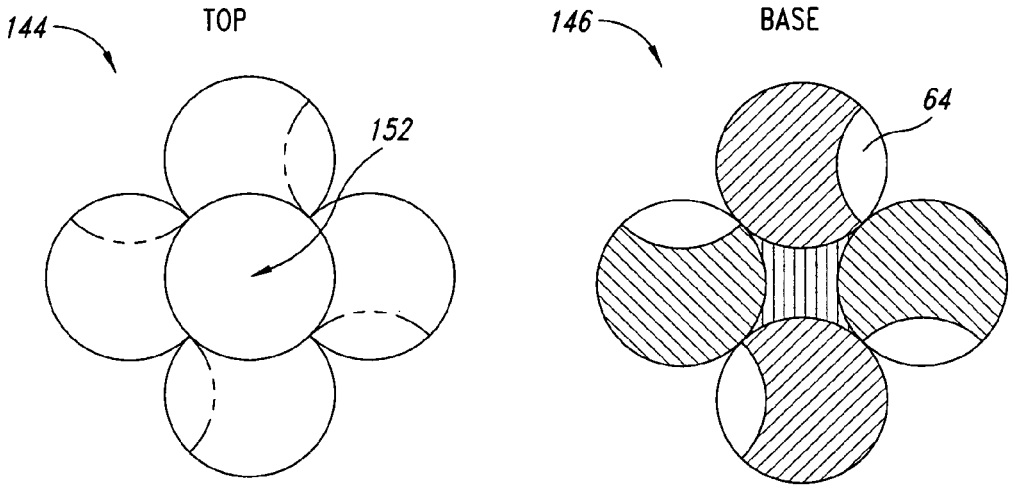
Figure 18A:
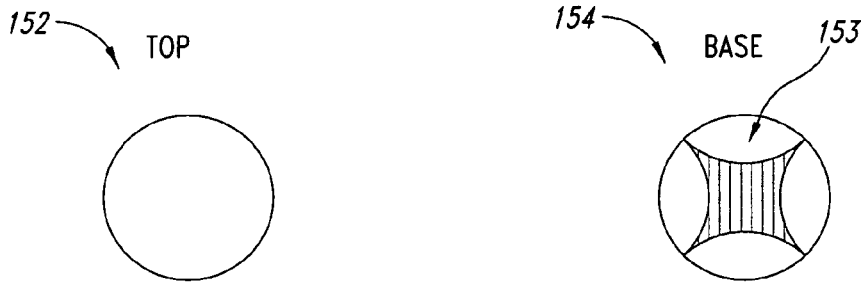

FIGS. 18A-18C show an alternative embodiment in which the center table 152 has a base 154 with four cutouts 153, and the peripheral tables 157 each have a tabletop with a cutout 151 in the top 159 and no cutout in the base 143. This is shown in the modular system 140, 142 of FIG. 18B. Alternatively, there may be at least one cutout 64 as shown in the modular system 144, 146 of FIG. 18C.

Figure 19A:
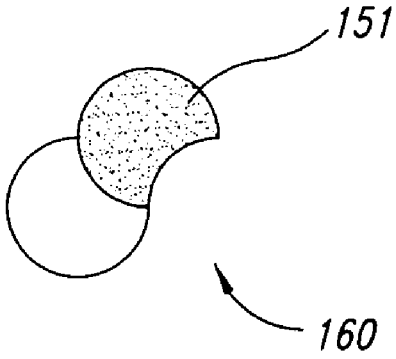
FIGS. 19A-19C are top plan form views of alternative embodiments of the modular table system formed in accordance with the present invention.
Figure 19B:
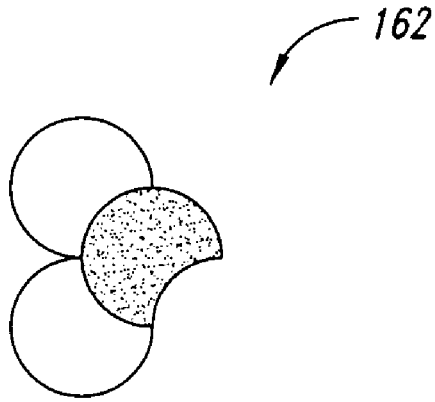
Figure 19C:
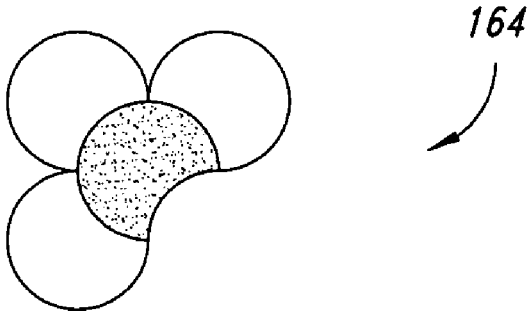

Referring now to FIGS. 19A-19C, other embodiments 160, 162, and 164 are shown respectively where the top 120 from FIG. 14A and the base 154 from FIG. 18A with four cutouts 153 is used in combination with other modular tabletop designs, such as one that employs a single cutout of the base, a double cutout of the base, or a triple cutout of the base as described in the various embodiments above. In this embodiment, the base 154 is can be used with any of the previously described tops 80, 100, or 120. It is to be understood that the open areas in the table top that are not filled in by another table top can be filled in with a matching filler section, appropriately held in place with releasable fasteners or removable fasteners, to provide a uniform planar top surface.

It is to be understood that any tabletop and base can be used to form the design shown in FIGS. 19A-19C as long as the base has the appropriate number of cutouts for the appropriate modular system desired. For example to make the design and modular system 160, a top 80 and base 82 shown in FIG. 11A can be used in combination with the same top 80 and base 82 or in combination with a different top, such as the top 100 and the base 102 shown in FIG. 11B. The modular table system provided is adaptable to meet a user's needs and creative expression.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A modular tabletop for use with a first complementary tabletop mounted on a first support and having a mating portion formed thereon and a second complementary tabletop mounted on a second support and having a mating portion formed thereon, the modular tabletop comprising:

a top portion having an opening configured to receive the mating portion of the first complementary tabletop to thereby form a larger tabletop; and a base portion supporting the top portion, the base portion having an opening that is shaped to accommodate the mating portion of the second complementary tabletop to enable the modular tabletop to dovetail together with the first and second complementary tabletops.

2. The modular tabletop of claim 1 wherein the top portion has a circular plan form shape, and the removable section has a crescent shape.

3. A modular tabletop, comprising:

a base surface having a portion removed therefrom to form an opening having a predetermined shape; and a top surface having a portion removed to form an opening having the predetermined shape, the opening in the top surface positioned so that the opening in the top surface does not overlap the opening in the base surface.

4. The modular tabletop of claim 3 wherein the openings of the top surface and the base surface have the same size.

5. The modular tabletop of claim 3 wherein the opening in the top surface is positioned radially 90 degrees from the opening in the base surface.

6. A modular tabletop, comprising:

a base layer having a circular plan form configuration with a crescent-shaped cutout; and a top layer formed on the base layer, the top layer having a circular plan form shape with a crescent-shaped cutout, the crescent-shaped cutout in the top layer positioned to not overlap the crescent-shaped cutout of the base layer.

7. The modular tabletop of claim 6 wherein the crescent-shaped cutout of the top layer is of equal size to the crescent-shaped cutout in the base layer.

8. The modular tabletop of claim 7 wherein the crescent-shaped cutout of the top layer is positioned radially 90 degrees apart from the crescent-shaped cutout of the base layer.

9. A modular table, comprising:

a modular tabletop, comprising:

a top having at least one open area in the top that is configured to receive a portion of another tabletop to form a larger tabletop, wherein the top has a circular plan form configuration; and a base mounted on at least one support structure, the base having at least one open area configured to accommodate a further tabletop, the top supported on the base with the at least one open area in the base positioned to not overlap the at least one open area in the top; and at least one removable crescent-shaped section sized and shaped to be received in the at least one open area in the top to fill in the at least one open area.

10. The modular table of claim 9 where in the top and the base are formed as a unitary structure.

11. The modular table of claim 10 wherein at least one open area in the top is positioned radially 90 degrees apart from the at least one open area in the base.

12. A modular table system, comprising:

a plurality of modular tables, each modular table comprising:

a tabletop having at least one opening in an integral top surface of the tabletop configured to accommodate a portion of another tabletop in butting relationship to form a larger tabletop, and at least one opening in an integral bottom surface of the tabletop configured to accommodate a portion of a further tabletop, the at least one opening in the top surface of the tabletop positioned to not overlap the at least one opening in the bottom surface of the tabletop.

13. The system of claim 12 wherein the tabletop has a circular plan form shape and the at least one opening in each of the top and bottom portions is crescent-shaped and having a radius identical to a radius of the circular-shaped tabletop.

14. The system of claim 13 wherein the at least one opening in the top portion of the table top is position radially 90 degrees apart from the at least one opening in the bottom portion of the tabletop.

15. A modular table system, comprising:

a plurality of tables, each table comprising a tabletop having an integral top surface having a circular plan form shape with at least one crescent-shaped cutout of same radius as the top and an integral bottom surface having a circular plan form shape with at least one crescent-shaped cutout of same radius as the bottom surface and positioned on the bottom surface radially 90 degrees apart from the at least one opening in the top surface.

16. The system of claim 15 wherein the tabletop is formed of a transparent material.

17. The system of claim 16 wherein the tabletop is formed of a top portion tinted with a first color and a bottom portion that is tinted with a second color so that when the top portion and the bottom portion overlap, a third color is visible.

18. The system of claim 15, further comprising a light source to illuminate the tabletop.

19. The system of claim 18 wherein the source of illumination is mounted below the tabletop.

20. A modular table for use on a supporting surface, comprising:

a base having at least one portion removed therefrom to form a corresponding at least one opening having a predetermined shape; and a tabletop having at least one portion removed to form a corresponding at least one opening having the predeter mined shape, the tabletop positioned and supported on the base so that the at least one opening in the tabletop does not overlap the at least one opening in the base, and the base configured to support the tabletop on the supporting surface.

21. A modular article, comprising:

a top section having at least one portion removed to form a corresponding at least one opening having a predetermined shape; and a base section having at least one portion removed to form a corresponding at least one opening having the predetermined shape, the base section having a top surface on which the top section is positioned and supported so that the at least one opening in the top section does not overlap the at least one opening in the base section, the base section configured to provide support for the top section.

22. A modular table, comprising:

a modular tabletop, comprising:

a top having at least one open area in the top that is configured to receive a portion of another tabletop to form a larger tabletop; and a base mounted on at least one support structure, the base having at least one open area configured to accommodate a further tabletop, the top supported on the base with the at least one open area in the base positioned to not overlap the at least one open area in the top, wherein the top and the base are formed as a unitary structure; and at least one removable section sized and shaped to be received in the at least one open area in the top to fill in the at least one open area.

* * * * *